US006656897B1

(12) United States Patent
Cardola et al.

(10) Patent No.: US 6,656,897 B1
(45) Date of Patent: Dec. 2, 2003

(54) ENAMEL SAFE CLEANING PROCESS

(75) Inventors: Sergio Cardola, Rome (IT); Panos Iakovides, Rome (IT); Laura Orlandini, Bacoli (IT); Maria Rosa Rescio, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/856,593

(22) PCT Filed: Nov. 29, 1999

(86) PCT No.: PCT/US99/28179

§ 371 (c)(1),
(2), (4) Date: May 23, 2001

(87) PCT Pub. No.: WO00/32737

PCT Pub. Date: Jun. 8, 2000

(30) Foreign Application Priority Data

Dec. 8, 1998 (EP) ..... 98870262

(51) Int. Cl.[7] ..... C11D 3/20; C11D 3/44

(52) U.S. Cl. ..... 510/239; 510/238; 510/240; 134/3

(58) Field of Search ..... 510/417, 434, 510/477, 202, 206, 201, 238, 432, 240, 239; 134/3, 40, 28, 38

(56) References Cited

U.S. PATENT DOCUMENTS

| | | | | | |
|---|---|---|---|---|---|
| 4,647,458 | A | * | 3/1987 | Ueno et al. | 424/605 |
| 5,008,030 | A | * | 4/1991 | Cook et al. | 510/384 |
| 5,192,460 | A | * | 3/1993 | Thomas et al. | 510/238 |
| 5,472,629 | A | | 12/1995 | Lysy et al. | |
| 5,582,762 | A | * | 12/1996 | Labeque et al. | 510/321 |
| 6,114,298 | A | * | 9/2000 | Petri et al. | 510/372 |

FOREIGN PATENT DOCUMENTS

| | | |
|---|---|---|
| BE | 773 757 | 1/1972 |
| CA | 951211 | 7/1974 |
| DE | 138 782 | 11/1979 |
| DE | 290 019 | 5/1991 |
| EP | 589 761 A1 | 3/1994 |
| HU | 60323 | 8/1992 |
| SU | 633896 | 11/1978 |

* cited by examiner

*Primary Examiner*—Gregory E. Webb
(74) *Attorney, Agent, or Firm*—Dinsmore & Shohl LLP

(57) ABSTRACT

The present invention describes a process of cleaning an enamel surface with a liquid acidic composition comprising an enamel safe acid wherein the $pK_a$ of said acid is 3.5 or higher, with the proviso that non mono-lower alkyl ethers or phenyl ethers or benzyl ethers of diethylene glycol, wherein the lower alkyl is of 2 to 6 carbon atoms, are present in said composition. The composition employed in said process is safe to enamel.

10 Claims, No Drawings

ENAMEL SAFE CLEANING PROCESS

TECHNICAL FIELD

The present invention relates to a process of cleaning enamel surfaces with a liquid acidic composition.

BACKGROUND OF THE INVENTION

Compositions for cleaning enamel surfaces are well known in the art.

Liquid compositions having an acidic pH for cleaning enamel surfaces have been extensively described in the art, especially in hard surface cleaning application (e.g., bathroom cleaner).

Indeed, it is known to use acidic compositions to clean enamel surfaces as such formulations show good soap scum removal performance and limescale removal performance. Soap scum and limescale are soils that frequently occur on enamel surfaces, especially enamel surfaces located in bathrooms, kitchens and the like.

However, there are some limitations to the convenience of acidic compositions employed as enamel surface cleaner. In particular it is know, that enamel surfaces are sensitive to acids and may be severely damaged by acidic compositions used to clean said surfaces.

It is thus and object of the present invention to provide a process of cleaning enamel surfaces with an acidic composition which is safe to said enamel surfaces whilst also exhibiting good cleaning performance on a variety of soils.

It has now been found that the above object is met by a process of cleaning an enamel surface with a liquid acidic composition comprising an enamel safe acid.

Advantageously, said process of cleaning enamel surfaces may be used on various enamel surfaces. Enamel surfaces can be found in various places, e.g., in households in kitchens (sinks and the like); in bathrooms (tubs, sinks, shower tiles, bathroom enamelware and the like); in washing machines; and dishes.

A further advantage of the process as described herein is that the compositions used to clean enamel surfaces show good stain/soil removal performance.

More particularly, the liquid acidic compositions show good stain/soil removal performance on various types of stains/soils in particular greasy soils, e.g., greasy soap scum or greasy soils found in kitchens; limescale; mold; mildew; and other tough stains found on enamel surfaces.

BACKGROUND ART

U.S. Pat. No. 4,501,680 discloses acidic liquid detergent compositions comprising mixtures of organic acids, an ether of diethylene glycol and a surfactant.

SUMMARY OF THE INVENTION

The present invention encompasses a process of cleaning an enamel surface with a liquid acidic composition comprising an enamel safe acid wherein the $pK_a$ of said acid is 3.5 or higher; with the proviso that no mono-lower alkyl ethers or phenyl ethers or benzyl ethers of diethylene glycol, wherein the lower alkyl is of 2 to 6 carbon atoms, are present in said composition.

In another preferred embodiment said composition further comprises a surfactant.

The present invention further encompasses the use of an enamel safe acid in a composition to clean an enamel surface wherein the $pK_a$ of said acid is 3.5 or higher and said composition is safe to enamel.

DETAILED DESCRIPTION OF THE INVENTION

The Process of Treating a Hard-surface

The present invention encompasses a process of treating an enamel surface with a liquid acidic composition comprising an enamel safe acid as described herein. In a preferred embodiment said acidic liquid composition is contacted with said enamel surface.

By "enamel surface" it is meant herein any kind of surface being made of or coated with enamel.

By "enamel" it is meant titanium or zirconium white enamel or titanium or zirconium white powder enamel used as a coating for metal (e.g., steel) surfaces preferably to prevent corrosion of said metal surfaces.

Enamel surfaces can typically be found in: houses: e.g., in bathrooms or in kitchens: e.g., tiles, sinks, showers, shower wash basins, WCs, tubs, sinks, fixtures and fittings and the like. Furthermore, cookware, dishes and the like may have an enamel surface. Enamel surfaces may also be found on household appliances which may be coated with enamel on their inside and/or outside surface including, but not limited to heating boiler, washing machines, automatic dryers, refrigerators, freezers, ovens, microwave ovens, dishwashers and so on. Further enamel surfaces may be found in industrial, architectural and the like applications. Examples of enamel surfaces found in said applications include enamel surfaces on or in tanks, pipelines, reaction vessels, pumps, chemical processing equipment, mechanical equipment, heat exchangers, hot water tanks, signs, silos or architectural panels.

The process of the present invention provides that the liquid acidic composition is applied to the surface to be treated. The composition may be in its neat form or in its diluted form.

By "diluted form", it is meant herein that said liquid composition is diluted by the user typically with water. The composition is diluted prior to use to a typical dilution level of 10 to 400 times its weight of water, preferably from 10 to 200 and more preferably from 10 to 100. A usually recommended dilution level is a 1.2% dilution of the composition in water.

By "in its neat form", it is to be understood that the liquid compositions are applied directly onto the enamel surface to be treated without undergoing any dilution, i.e., the liquid compositions herein are applied onto the hard-surface as described herein.

A preferred process of cleaning an enamel surface according to the present invention, is to apply the composition in diluted form without rinsing the hard-surface after application in order to obtain good soil/stain removal performance.

Another preferred process of treating a enamel surface, is to apply the composition, described by the present invention, either in neat or diluted form, leave it on said surface for a period of time to allow the composition to act, optionally wipe said surface with an appropriate instrument, e.g., a sponge, and then preferably rinse said surface with water.

The enamel surfaces to be treated may be soiled with a variety of soils, e.g., greasy soils (e.g., greasy soap scum, body grease, kitchen grease or burnt/sticky food residues typically found in a kitchen and the like) or so called "limescale-containing stains". By "limescale-containing stains" it is meant herein any pure limescale stains, i.e., any stains composed essentially of mineral deposits, as well as limescale-containing stains, i.e., stains which contain not only mineral deposits like calcium and/or magnesium carbonate but also soap scum (e.g., calcium stearate) and other grease (e.g. body grease).

Cleaning Performance Test Method

The dilute cleaning performance may be evaluated by the following test method: tiles of enamel are prepared by applying to them a representative grease/particulate artificial soil followed by ageing. The test compositions and the reference composition are diluted (e.g., composition:water 1:50 or 1:100), applied to a sponge, and used to clean the tiles with a Sheen scrub tester. The number. of strokes required to clean to 100% clean is recorded. The result, i.e., number of strokes, of the test composition is compared against the result of the reference composition.

The test method for evaluating neat cleaning performance is identical to above except that the test compositions and reference are used undiluted and that after cleaning a rinsing cycle is performed with clean water.

Greasy Soap Scum Cleaning Performance Test Method

In this test method enamel white tiles (typically 24 cm*4 cm) are covered with typical greasy soap scum soils mainly based on calcium stearate and artificial body soils commercially available (e.g., 0.3 grams with a sprayer). The soiled tiles are then dried in an oven at a temperature of 140° C. for 20 minutes and then aged overnight at room temperature (around 20° C.–25° C.). The soiled tiles are then cleaned using 3 ml of the liquid composition of the present invention poured directly onto a Spontex® sponge. The ability of the composition to remove greasy soap scum is measured through the number of strokes needed to perfectly clean the surface. The lower the number of strokes, the higher the greasy soap scum cleaning ability of the composition.

The Liquid Acidic Composition

The liquid acidic compositions according to the present invention are preferably, aqueous compositions. Therefore, they may comprise from 70% to 99%, preferably from 75% to 95% and more preferably from 85% to 95% by weight of the total composition of water.

The liquid compositions of the present invention are acidic and therefore preferably have a pH below 7, preferably from 1 to 6.5, more preferably from 1 to 5, even more preferably from 2 to 5 and most preferably from 2 to 4.

The compositions according to the present invention are advantageously chemically stable, i.e., there are virtually no chemical reactions between the different ingredients of the compositions, and physically stable, i.e., that no phase separation occurs when stored in rapid aging test (RAT), i.e., storage at 50° C. for 10 days.

A proviso of the present invention is that the compositions do not contain a mono-lower alkyl ether or phenyl ether or benzyl ether of diethylene glycol, wherein the lower alkyl is of 2 to 6 carbon atoms.

Enamel Safe Acid

As an essential ingredient the compositions used in a process according to the present invention comprise an enamel safe acid as described herein. Said enamel safe acid has a $pK_a$ of 3.5 or higher. Preferably the $pK_a$ of said enamel safe acid is higher than 4.0. More preferably the $pK_a$ of said enamel safe acid is higher than 4.5.

Typically the compositions of the present invention may comprise from 0.1% to 10%, preferably from 0.1% to 8% and more preferably from 0.1% to 6% by weight of the total composition of said enamel safe acid.

Suitable enamel safe acids having a $pK_a$ of 3.5 or higher are organic or inorganic acids having a $pK_a$ of 3.5 or higher or mixtures thereof.

Suitable organic acids having a $pK_a$ of 3.5 or higher are aromatic or aliphatic organic acids having a $pK_a$ of 3.5 or higher or mixtures thereof.

Examples of suitable aliphatic organic enamel safe acids are selected form the group consisting of: acetic acid; acetoacetic acid; acrylic acid; anisic acid; ascorbic acid; formic acid; glutaric acid; glycolic acid; adipamic acid; adipic acid; anisylpropionic acid; aspartic acid; barbituric acid; butyric acid; caproic acid; β-chlorobutyric acid; γ-chlorobutyric acid; chlorocinnamic. acid; cinnamic acid; crotonic acid; gallic acid; glutaramic acid; heptanoic acid; hexanoic acid; hippuric acid; hydroxybutyric acid; β-hydroxypropionic acid; itaconic acid; mesitylenic acid; methylcinnamic acid; methylglutaric acid; methylsuccinic acid; octanoic acid; pimelic acid; propionic acid; suberic acid; succinic acid; uric acid; and valeric acid; and mixtures thereof.

Examples of suitable aromatic organic enamel safe acids are selected form the group consisting of o-aminobenzoic acid; m-aminobenzoic acid; p-aminobenzoic acid; benzoic acid; m-brombenzoic acid; m-chlorobenzoic acid; p-chlorobenzoic acid; o-chlorophenylacetic acid; m-chlorophenylacetic acid; p-chlorophenylacetic acid; β-(o-chlorophenyl) propionic acid; β-(m-chlorophenyt) propionic acid; β-(p-chlorophenyl) propionic acid; 3,4-dihydroxybenzoic acid; 3,5-dihydroxybenzoic acid; 2,4-dinitrophenol; 3,6-dinitrophenol; diphenylacetic acid; ethylphenylacetic acid; hexahydrobenzoic acid; m-hydroxybenzoic acid; p-hydroxybenzoic acid; α-naphtoic acid; β-naphtoic acid; nitrobenzene; o-nitrophenol; m-nitrophenol; p-nitrophenol; o-nitrophenylacetic acid; m-nitrophenylacetic acid; p-nitrophenylacetic acid; o-β-nitrophenylpropionic acid; p-β-nitrophenylpropionic acid; phenylacetic acid; γ-phenylbutyric acid; α-phenylpropionic acid; β-phenylpropionic acid; m-phthalic acid; p-phthalic acid; o-toluic acid; m-toluic acid; and p-toluic acid; and mixtures thereof.

Examples of suitable inorganic enamel safe acids are selected form the group consisting of: o-boric acid; carbonic acid; germanic acid; hydrocyanic acid; hydrogen sulfide; m-silicic acid; o-silicic acid; telluric acid; and tetraboric acid; and mixtures thereof.

Preferably said enamel safe acids having a $pK_a$ of 3.5 or higher are organic or inorganic acids having a $pK_a$ of 3.5 or higher or mixtures thereof. More preferably said enamel safe acids having a $pK_a$ of 3.5 or higher are aromatic or aliphatic organic acids having a $pK_a$ of 3.5 or higher; or inorganic acids having a $pK_a$ of 3.5 or higher; or mixtures thereof.

Preferred aliphatic organic enamel safe acids are selected form the group consisting of: acetic acid; acetoacetic acid; acrylic acid; anisic acid; ascorbic acid; formic acid; glutaric acid; glycolic acid; succinic acid; and adipic acid; and mixtures thereof.

Preferred aromatic organic enamel safe acids are selected form the group consisting of: benzoic acid; o-aminobenzoic acid; m-aminobenzoic acid; p-aminobenzoic acid; 3,4-dihydroxybenzoic acid; 3,5-dihydroxybenzoic acid; and phenylacetic; and mixtures thereof.

Preferred inorganic enamel safe acids are selected form the group consisting of: telluric acid; carbonic acid; and hypochlorous acid; and mixtures thereof.

Even more preferred enamel safe acids having a $pK_a$ of 3.5 or higher are selected form the group consisting of: acetic acid; acetoacetic acid; glutaric acid; adipic acid; succinic acid; and benzoic acid; and mixtures thereof. The most preferred enamel safe acids having a $pK_a$ of 3.5 or higher are selected form the group consisting of: acetic acid; giutaric acid; adipic acid; and succinic acid; and mixtures thereof.

Suitable acids are commercially available from Aldrich, ICI and BASF.

The present invention is based on the finding that a process of cleaning enamel with a liquid acidic composition comprising an enamel safe acid as described herein is safe to enamel surfaces.

In a preferred embodiment according to the present invention the compositions used in a process of cleaning an enamel surface do not comprise any acids having a $pK_a$ of less than 3.5, more preferably less than 4.0.

Another aspect of the present invention is the use of an enamel safe acid in a composition to clean an enamel surface wherein the $pK_a$ of said acid is 3.5 or higher; whereby said composition is safe to enamel.

By "safe to enamel surfaces" it is meant herein that the acidic compositions as described herein prevent or at least reduce damage to enamel surfaces treated therewith as compared to other acidic compositions.

It is believed that damage to enamel surfaces may be caused by cations, most likely small cations, i.e., cations having an ionic radius of 115 pm or less, present in an acidic composition used to treat said enamel surface. Such cations may be present in acidic compositions for example where a buffer ingredient or a buffering system is used to adjust the pH of said composition. The cations are believed to penetrate and spread through the superficial layers of the crystalline lattice of enamel. Said cations may eventually replace cations originally present in said superficial layers of the crystalline lattice of enamel and/or otherwise modify said superficial layers of the crystalline lattice of enamel. The result of such a replacement is that the enamel surface eventually looses its smoothness and consequently its gloss, i.e., shine. The loss of gloss is perceived by consumers as damage to an enamel surface.

Whilst not wishing to be bound by theory, it is believed that by using an acid having a $pK_a$ of 3.5 or higher in an enamel cleaning composition, the pH of said composition is in an optimal range to achieve good cleaning performance whilst still being safe to the treated enamel surface, i.e., the composition is acidic, preferably the pH is below 7, more preferably the pH is from 1 to 6.5, still more preferably the pH is from 1 to 5, even more preferably the pH is from 2 to 5 and most preferably the pH is from 2 to 4, and therefore, the pH does not need further adjustment. Thus, there is no need to employ a buffer ingredient or a buffering system other than the enamel safe acid itself. Thus, it is believed that less enamel-damaging cations are present in the enamel cleaning composition.

Thus, the compositions used in a process to clean an enamel surface as described herein are safe to said enamel surfaces.

The degree of enamel damage can be determined by the following enamel damage test method

Enamel Damage Test Method

A few drops of the composition according to the present invention in its neat or dilute form are placed on an enamel surface (e.g., an enamel tile) afterwards, the surface is covered with a watch-glass. After 15 minutes, the watch-glass is removed, the enamel surface is rinsed with water (either demineralised or tap) and then wiped dry. Visual examination (visual grading) or gloss measurements of the surface allow to verify whether the product is safe (no difference of gloss versus the untreated enamel surface) or unsafe (difference of gloss versus the untreated enamel surface) to enamel.

Optional Surfactant

The liquid compositions of the present invention may preferably comprise a surfactant. Surfactants may be desired herein as they further contribute to the cleaning performance of the compositions of the present invention.

Surfactants to be used herein include nonionic surfactants, cationic surfactants, anionic surfactants, zwitterionic surfactants, amphoteric surfactants, and mixtures thereof.

Accordingly, the compositions according to the present invention may comprise up to 15%, more preferably from 0.5% to 8%, even more preferably from 0.5% to 8%, and most preferably 0.5% to 8% by weight of the total composition of a surfactant.

Suitable nonionic surfactants for use herein include a class of compounds, which may be broadly defined as compounds produced by the condensation of alkylene oxide groups (hydrophilic in nature) with an organic hydrophobic compound, which may be branched or linear aliphatic (e.g., Guerbet or secondary alcohol) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Accordingly suitable nonionic synthetic detergents include:

(i) The polyethylene oxide condensates of alkyl phenols, e.g., the condensation products of alkyl phenols having an alkyl group containing from 6 to 20 carbon atoms in either a straight chain or branched chain configuration, preferably from 8 to 14, and more preferably from 8 to 12 carbon atoms, with ethylene oxide. Said ethylene oxide is typically present in amounts of from 3 to 25, preferably from 10 to 25 moles of ethylene oxide per mole of alkyl phenol. The alkyl substituent in such compounds may be derived from polymerized propylene, diisobutylene, octane, and nonane; Examples of this type of nonionic surfactants include Triton N-57® a nonyl phenol ethoxylate (5EO) from Rohm & Haas and Imbentin O200® an octyl phenol ethoxylate (20EO) from KOLB.

(ii) Those derived from the condensation of ethylene oxide with the product resulting from the reaction of propylene oxide and ethylene diamine products which may be varied in composition depending upon the balance between the hydrophobic and hydrophilic elements which is desired. Examples are compounds containing from 40% to 80% polyoxyethylene by weight and having a molecular weight of from 5000 to 11000 resulting from the reaction of ethylene oxide groups with a hydrophobic base constituted of the reaction product of ethylene diamine and excess propylene oxide, said base having a molecular weight of the order of 2500 to 3000. Examples of this type of nonionic surfactants include certain of the commercially available Tetronic™ compounds, marketed by BASF.

(iii) The condensation product of aliphatic alcohols having from 2 to 24 carbon atoms, in either straight chain or branched chain configuration, preferably from 6 to 22, more preferably from 6 to 28, and even more preferably 8 to 18 carbon atoms, with from 2 to 35, preferably from 4 to 25, more preferably from 5 to 18, and even more preferably 3 to 15 moles of ethylene oxide. Examples of this type of material are a coconut alcohol ethylene oxide condensate having from 5 to 18 moles of ethylene oxide per mole of coconut alcohol, the coconut alcohol fraction having from 9 to 14 carbon atoms. Other examples of this type of nonionic surfactants include certain of the commercially available Dobanol®, Neodol® marketed by Shell or Lutensol® from BASF. For example Dobanol® 23.5 (C12–C13 EO5), Dobanol® 91.5 (C9–C11 EO5), Dobanol® 91.8 (C9–C11 EO8) and Lutensol® AO30 (C12–C14 EO30).

(iv) Trialkyl amine oxides and trialkyl phosphnine oxides wherein one alkyl group ranges from 10 to 18 carbon atoms and two alkyl groups ranges from 1 to 3 carbon atoms; the alkyl groups can contain hydroxy sub stituents; specific examples are dodecyl di(2-hydroxyethyl)amine oxide and tetradecyl dimethyl phosphine oxide, (v) The condensation products of ethylene oxide with a hydrophobic base formed by the condensation of propylene oxide with propylene glycol; The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is 50% of the total weight of the condensation product, which corresponds to condensation with up to 40 moles of ethylene oxide. Examples of compounds of this type include certain of the commercially available Pluronic™ surfactants, marketed by BASF.

Also useful as a nonionic surfactant are the alkylpolysaccharides disclosed in U.S. Pat. No. 4,565,647, Lienado, issued Jan. 21, 1986, having a hydrophobic group containing from 6 to 30 carbon atoms, preferably from 10 to 16 carbon atoms and polysaccharide, e.g., a polyglycoside, hydrophilic group containing from 1.3 to 10, preferably from 1.3 to 3, most preferably from 1.3 to 2.7 saccharide units. Any reducing saccharide containing 5 or 6 carbon atoms can be used, e.g., glucose, galactose, and galactosyi moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions of the preceding saccharide units.

Optionally, and less desirable, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group can contain up to 3 hydroxy groups and/or the polyalkyleneoxide chain can contain up to 10, preferably less than 5, alkyleneoxide moieties. Suitable alkyl polysaccharides are octyl, nonyidecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantely. the 2-position.

Other suitable nonionic surfactants for use herein include polyhydroxy fatty acid amides of the structural formula:

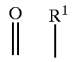

$$R^2—\overset{\overset{\displaystyle O}{\|}}{C}—\overset{\overset{\displaystyle R^1}{|}}{N}—Z \qquad (I)$$

wherein: $R^1$ is H, $C_1$–$C_4$ hydrocarbyl, 2-hydroxy ethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl. $R^2—CO—N<$ can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Other suitable nonionic surfactants for use herein include the amine oxides corresponding to the formula:

$$RR'R''N\rightarrow O$$

wherein R is a primary alkyl group containing from 6 to 24 carbons, preferably from 10 to 18 carbons, and wherein R"

and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains from 10 to 18 carbons and R' and R" are both methyl. Exemplary of the preferred amine oxides are the N-hexyldimethylamine oxide, N-octyidimethylamine oxide, N-decyldimethylamine oxide, N-dodecyl dimethylamine oxide, N-tetradecyidimethylamine oxide, N-hexadecyl dimethylamine oxide, N-octadecyldimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyidimethylamine oxide.

Other suitable nonionic surfactants for the purpose of the invention are the phosphine or sulfoxide surfactants of formula:

$$RR'R''A\rightarrow O$$

wherein A is phosphorus or sulfur atom, R is a primary alkyl. group containing 6–24 carbons, preferably 10–18 carbons, and wherein R' and R" are, each, independently selected from methyl, ethyl and 2-hydroxyethyl. The arrow in the formula is a conventional representation of a semi-polar bond.

In a preferred embodiment herein suitable nonionic surfactants to be used are polyethylene oxide condensates of alkyl phenols, polyethylene oxide condensates of alkyl alcohols, alkylpolysaccharides, or mixtures thereof. Highly preferred are $C_6$–$C_{20}$, preferably $C_8$–$C_{12}$ alkyl phenol ethoxylates having from 3 to 25, preferably 10 to 25 ethoxy groups and $C_2$–$C_{24}$, preferably $C_8$–$C_{18}$ alcohol ethoxylates having from 2 to 35, preferably from 4 to 25, more preferably from 5 to 18 and most preferably from 3 to 15 ethylene oxide units, and mixtures thereof.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic. groups are carboxylates and sulfonates, although other groups like sulfates, phosphonates, and the like can be used.

A generic formula for preferred zwitterionic surfactants for use herein (i.e., betaine and/or sulfobetaine) is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1to 10 carbon atoms; and X is the hydrophilic group which is a carboxylate or sulfonate group, preferably sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24, preferably from 8 to 18, and more preferably from 10 to 16 carbon atoms. These simple alkyl groups are preferred for cost and stability reasons. However, the hydrophobic group $R_1$ can also be an amido radical of the formula $R_a$—C(O)—$NR_b$—$(C(R_c)_2)_m$, wherein $R_a$ is an aliphatic or aromatic, saturated or unsaturated, substituted or unsubstituted hydrocarbon chain containing from 8 up to 20 carbon atoms, preferably an alkyl group containing from 8 up to 20, preferably up to 18, more preferably up to 16 carbon atoms, $R_b$ is either a hydrogen a short chain alkyl or substituted alkyl containing from 1 to 4 carbon atoms, preferably a group selected from the group consisting of methyl, ethyl, propyl, hydroxy substituted ethyl or propyl and mixtures thereof, more preferably methyl or hydrogen, $R_c$ is selected from the group consisting of hydrogen and hydroxy groups, and m is from 1 to 4, preferably from 2 to 3, more preferably 3, with no more than one hydroxy group in any $(C(R_c)_2)$ moiety.

Preferred $R_2$ is hydrogen, or an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_3$ is a $C_1$–$C_4$ carboxylic acid group, a $C_1$–$C_4$ sulfonate group, or, an alkyl or substituted alkyl containing from 1 to 4 carbon atoms, preferably a group selected from the group consisting of methyl, ethyl, propyl, hydroxy substituted ethyl or propyl and mixtures thereof, more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyidimethyl betaines include coconut-dimethyl betaine, lauryl dimethyl betaihe, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-imminodipropionate commercially available from Rhone-Poulenc under the trade name Mirataine H2C-HA®.

Particularly preferred zwitterionic surfactants for use in the compositions of the present invention are the sulfobetaine surfactants as they deliver optimum grease cleaning benefits.

Examples of particularly suitable sulfobetaine surfactants include tallow bis(hydroxyethyl) sulphobetaine, cocoamido propyl hydroxy sulfobetaines which are commercially available from Rhone Poulenc and Witco, under the trade name of Mirataine CBSX and Rewoteric AM CAS 15® respectively.

Further examples of amidobetaines/amidosulfobetaine include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

Suitable amines for use herein are according to the following formula RR'R"N wherein R is a saturated or unsaturated, substituted or unsubstituted, linear or branched alkyl groups containing from 1 to 30 carbon atoms, and preferably from 1 to 20 carbon atoms and wherein R' and R" are independently saturated or unsaturated, substituted or unsubstituted,. linear or branched alkyl groups containing from 1 to 30 carbon atoms or hydrogen. Particularly preferred amines to be used according to the present invention are amines having the following formula RR'R"N wherein R is a saturated or unsaturated, linear or branched alkyl group containing from 1 to 30 carbon atoms, preferably from 8 to 20, more preferably from 6 to 16, most preferably from 8 to 14 carbon atoms and wherein R' and R" are independently substituted or unsubstituted, linear or branched alkyl groups containing from 1 to 4 carbon atoms, preferably from 1 to 3 carbon atoms, and more preferably are methyl groups, or mixtures thereof.

Suitable amines for use herein are for instance $C_{12}$ dimethyl amine, coconut dimethyl amine, $C_{12}$–$C_{16}$ dimethyl amine. Said amines may be commercially available from Hoechst under the trade name Genamin®, AKZO under the trade name Aromox® or Fina under the trade name Radiamine®.

Suitable quatemary ammonium surfactants for use herein are according to the formula $R_1R_2R_3R_4N^+X^-$, wherein X is a counteranion such as halogen, methyl sulphate, methyl sulphonate, or hydroxide, $R_1$ is a saturated or unsaturated, substituted or unsubstituted, linear or branched alkyl group containing from 1 to 30 carbon atoms, preferably from 12 to 20, more preferably from 8 to 20 carbon atoms and $R_2$, $R_3$ and $R_4$ are independently hydrogen, or saturated or unsaturated, substituted or unsubstituted, linear or branched alkyl groups containing from 1 to 4 carbon atoms, preferably from 1 to 3 and more preferably methyl. In highly preferred quatemary ammonium surfactants herein $R_1$ is a $C_{10}$–$C_{18}$ hydrocarbon chain, most preferably $C_{12}$, $C_{14}$, or $C_{16}$, and $R_2$, $R_3$ and $R_4$ are all three methyl, and X is halogen, preferably bromide or chloride, most preferably bromide.

Examples of quaternary ammonium surfactants are myristyl trimethylammonium methyl sulphate, cetyl trimethylammonium methyl sulphate, lauryl trimethyl ammonium bromide, stearyl trimethyl ammonium bromide (STAB), cetyl trimethyl ammonium bromide (CTAB) and myristyl trimethyl ammonium bromide (MTAB). Highly preferred herein are lauryl trimethyl ammonium salts. Such trimethyl quaternary ammonium surfactants may be commercially available from Hoechst, or from Albright & Wilson under the trade name Empigen CM®.

Cationic surfactants suitable for use in compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than 1000, and hydrogen when y is not 0; $R^5$ is the same as $R^4$ or is an alkyl chain wherein the total number of carbon atoms of $R^2$ plus $R^5$ is not more than 18; each y is from 0 to 10 and the sum of the y values is from 0 to 15; and X is any compatible anion.

Other cationic surfactants useful herein are also described in U.S. Pat. No. 4,228,044, Cambre, issued Oct. 14, 1980, incorporated herein by reference.

Amphoteric and ampholytic detergents which can be either cationic or anionic depending upon the pH of the system are represented by detergents such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

Suitable anionic surfactants for use herein are all those commonly known by those skilled in the art. Preferably, the anionic surfactants for use herein include alkyl sulphonates, alkyl aryl sulphonates, alkyl sulphates, alkyl alkoxylated sulphates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium catioris derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trirnethyl ammonium cations and quatemary ammonium cations, such as tetramethyl-ammonium and dimethyl piperdinium cations and quaternary ammonium cations derived from alkylamines such as ethylamine, diethylamine, triethylamine, and mixtures thereof, and the like).

An example of a $C_{14}$–$C_{16}$ alkyl sulphonate is Hostapure SAS available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable alkyl sulphate surfactants for use herein are according to the formula $R_1SO_4M$ wherein $R_1$ represents a hydrocarbon group selected from the group consisting of straight or branched alkyl radicals containing from 6 to 20 carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quatemary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly preferred branched alkyl sulphates to be used herein are those containing from 10 to 14 total carbon atoms like Isalchem 123 AS®. Isalchem 123 AS® commercially available from Enichem is a $C_{12-13}$ surfactant which is 94% branched. This material can be described as $CH_3—(CH_2)_m—CH(CH_2OSO_3Na)—(CH_2)_n—CH_3$ where n+m=8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include $C_{12}$–$C_{16}$ paraffin sulphonate like Hostapur® SAS commercially available from Hoechst.

Suitable alkyl alkoxylated sulphate surfactants for use herein are according to the formula $RO(A)_mSO_3M$ wherein R is an unsubstituted $C_6$–$C_{20}$ alkyl or hydroxyalkyl group having a $C_6$–$C_{20}$ alkyl component, preferably a $C_{12}$–$C_{20}$ aalkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate. ($C_{12}$–$C_{18}$E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0)SM), wherein M is conveniently selected from sodium and potassium.

Suitable $C_6$–$C_{20}$ alkyl alkoxylated linear or branched diphenyl oxide disulphonate surfactants for use herein are according to the following formula:

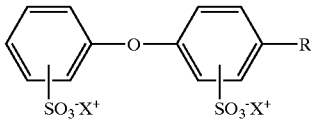

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide-disulphonate surfactants to be used herein are the C12 branched di phenyl oxide disulphonic acid and C16 linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$–$C_{24}$ olefinsulfonates, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Preferably the surfactants to be used herein as optional ingredients are selected from the group consisting of nonionic. surfactants, cationic surfactants, anionic surfactants, zwitterionic surfactants, amphoteric surfactants, and mixtures thereof. More preferably said surfactant is a nonionic surfactant or an anionic surfactant or a mixture thereof.

Other Optional Ingredients

The compositions herein may further comprise conventional enamel cleaning ingredients. Preferably, the liquid compositions according to the present invention may comprise a variety of optional ingredients depending on the technical benefit aimed for and the surface treated.

Suitable optional ingredients for use herein include a solvent, a builder, a chelant, a bactericide, a hydrotrope, a colorant, a stabilizer, a radical, scavenger, a vinylpyrrolidone homopolymer or copolymer, a polysaccharide polymer, a bleach, a bleach activator, a preservative, a suds controlling agent like a fatty acid, an enzyme, a soil suspender, a dye transfer agent, a brightener, an anti dusting agent, a dispersant, a dye transfer inhibitor, a pigment, a dye and/or a perfume.

Solvent

The compositions of the present invention may further comprise a solvent, as a highly preferred optional ingredient.

Solvents are desired herein because they contribute to the greasy soils cleaning performance of the composition herein.

Suitable solvents for use herein include glycols or alkoxylated glycols, alkoxylated aromatic alcohols, aromatic alcohols, aliphatic branched alcohols, alkoxylated aliphatic branched alcohols, alkoxylated linear $C_1$–$C_5$ alcohols, linear $C_1$–$C_5$ alcohols, $C_8$–$C_{14}$ alkyl and cycloalkyl hydrocarbons and halohydrocarbons and mixtures thereof with the proviso that said solvent is not a mono-lower alkyl ether or phenyl ether or benzyl ether of diethylene glycol, wherein the lower alkyl is of 2 to 6 carbon atoms.

Suitable glycols to be used herein are according to the formula $HO—CR_1R_2—OH$ wherein $R_1$ and $R_2$ are independently H or a $C_2$–$C_{10}$ saturated or unsaturated aliphatic hydrocarbon chain and/or cyclic. Suitable glycols to be used herein are dodecaneglycol and/or propanediol.

Suitable alkoxylated glycols to be used herein are according to the formula R—$(A)_n$—$R_1$—OH wherein R is H, OH, a linear saturated or unsaturated alkyl of from 1 to 20 carbon atoms, preferably from 2 to 15 and more preferably from 2 to 10 carbon atoms, wherein $R_1$ is a linear saturated or unsaturated alkyl of from 3 to 20 carbon atoms, preferably from 3 to 15 and more preferably from 3 to 10 carbon atoms, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R—$(A)_n$—OH wherein R is an alkyl substituted or non-alkyl substituted aryl group of from 1 to 20 carbon atoms, preferably from 2 to 15 and more preferably from 2 to 10 carbon atoms, wherein A is an alkoxy group preferably butoxy, propoxy and/or ethoxy, and n is an integer of from 1 to 5, preferably 1 to 2, with the proviso that n is not an integer of 2 if A is an ethoxy group. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10 carbon atoms. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12 carbon atoms. Particularly, suitable aliphatic branched alcohols to be used herein include 2-ethylbutanol and/or 2-methylbutanol.

Suitable alkoxylated aliphatic branched alcohols to be used herein are according to the formula R—$(A)_n$—OH wherein R is a branched saturated or unsaturated alkyl group of from 1 to 20 carbon atoms, preferably from 2 to 15 and more preferably from 5 to 12 carbon atoms, wherein A is an alkoxy group preferably butoxy, propoxy and/or ethoxy, and n is an integer of from 1 to 5, preferably 1 to 2, with the proviso that n is not an integer of 2, if A is an ethoxy group. Suitable alkoxylated aliphatic branched alcohols include 1-methylpropoxyethanol and/or 2-methylbutoxyethanol.

Suitable alkoxylated linear $C_1C_5$ alcohols to be used herein are according to the formula R—$(A)_n$—OH wherein R is a linear saturated or unsaturated alkyl group of from 1 to 5 carbon atoms, preferably from 2 to 4 carbon atoms, wherein A is an alkoxy group preferably butoxy, propoxy and/or ethoxy, and n is an integer of from 1 to 5, preferably 1 to 2, with the proviso that n is not an integer of 2 if A is an ethoxy group. Suitable alkoxylated aliphatic linear $C_1$–$C_5$ alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear $C_1$–$C_5$ alcohols to be used herein are according to the formula R—OH wherein R is a linear saturated or unsaturated alkyl group of from 1 to 5 carbon atoms, preferably from 2 to 4 carbon atoms. Suitable linear $C_1$–$C_5$ alcohols are methanol, ethanol, propanol or mixtures thereof.

Other suitable solvents include butyltriglycol ether, ter amilic alcohol and the like. Particularly preferred solvents to be used herein are butoxy propoxy propanol, benzyl alcohol, butoxypropanol, ethanol, methanol, isopropanol and mixtures thereof.

The preferred solvent for use herein is butoxy propoxy propanol (n-BPP).

Typically, the compositions of the present invention may comprise from 0.1% to 8%, preferably from 0.5% to 5% and more preferably from 1% to 3% by weight of the total composition of a solvent.

Vinylpyrrolidone Homopolymer or Copolymer

The compositions of the present invention may comprise a vinylpyrrolidone homopolymer or copolymer.

Typically, the compositions of the present invention may comprise from 0.01% to 5%, more preferably from 0.05% to 3% and most preferably from 0.05% to 1% by weight of the total composition of a vinylpyrrolidone homopolymer or copolymer.

Suitable vinylpyrrolidone homopolymers for use herein are homopolymers of N-vinylpyrrolidone having the following repeating monomer:

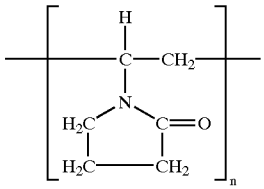

wherein n (degree of polymerisation) is an integer of from 10 to 1,000,000, preferably from 20 to 100,000, and more preferably from 20 to 10,000.

Accordingly, suitable vinylpyrrolidone homopblymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165® Sokalan HP 12®, Luviskol K30®, Luviskol K60®, Luviskol K80®, Luviskol K90® and other vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well-known monomers may be used.

The molecular weight of the copolymer of vinylpyrrolidone is not especially critical so long as the copolymer is water-soluble, has some surface activity and is adsorbed to the hard-surface from the liquid composition comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol®'series from BASF.

The copolymers of vinylpyrrolidone for use in the compositions of the present invention also include quaternized or unquaternized vinylpyrrolidone/dialkylaminoalkyl acrylate or methacrylate copolymers.

Such vinylpyrrolidone/dialkylaminoalkyl acrylate or methacrylate copolymers (quaternised or unquatemised) suitable to be used in the compositions of the present invention are according to the following formula:

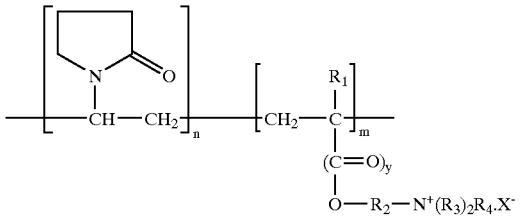

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group. of from 1 to 4 carbon atoms, preferably methyl or ethyl, or

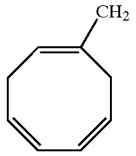

$R_4$ denotes a lower alkyl group of from 1 to 4 carbon atoms, preferably methyl or ethyl; $X^-$ is chosen from the group consisting of Cl, Br, I, 1/2 $SO_4$, $HSO_4$ and $CH_3SO_3$. The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Preferred vinylpyrrolidone homopolymers or copolymers for use herein are the vinylpyrrolidone homopolymers.

Polysaccharide Polymer

The compositions of the present invention may comprise a polysaccharide polymer.

Typically, the compositions of the present invention may comprise from 0.01% to 5%, more preferably from 0.05% to 3% and most preferably from 0.05% to 1% by weight of the total composition of a polysaccharide polymer.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like xanthan gum, guar gum, locust bean gum, tragacanth gum or derivatives thereof, or mixtures thereof.

Particularly polysaccharide polymers for use herein are xanthan gum and derivatives thereof. Xanthan gum and derivatives thereof may be commercially available for instance. from Kelco under the trade name Keltrol RD®, Kelzan S® or Kelzan T®. Other suitable Xanthan gum is commercially available by Rhone Poulenc under the trade name Rhodopol T® and Rhodigel X747®. Succinoglycan gum for use herein is commercially available by Rhone Poulenc under the trade name Rheozan®.

Dye

The liquid compositions according to the present invention may be coloured. Accordingly, they may comprise a dye. Suitable dyes for use herein are stable dyes. By "stable", it is meant herein a compound which is chemically and physically stable in the acidic environment of the compositions herein.

Preservative

The compositions according to the present invention may further comprise a preservative as an optional ingredient. Preservatives to be used herein include all those known to those skilled in the art ho hard-surface cleaner compositions. Preservatives are desired herein because they contribute to the stability of the compositions herein.

Suitable preservatives for use herein are diazolidinyl urea, triethyl citrate, propyl 4-hydroxybenzoate, sorbic acid, Na salt of p-hydroxybenzoate or gluteraldehyde or a mixture thereof.

Radical Scavenger

The compositions of the present invention may comprise a radical scavenger.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts up to 10% and preferably from 0.001% to 0.5% by weight of the total composition.

The presence of radical scavengers may contribute to the chemical stability of the compositions of the present invention.

Perfume

The compositions according to the present invention may further comprise a perfume.

Suitable perfumes for use herein include materials which provide an olfactory aesthetic benefit and/or cover any "chemical" odour that the product may have. The main function of a small fractions of the highly volatile, low boiling (having low boiling points), perfume components in these perfumes is to improve the fragrance odour of the product itself, rather than impacting on the subsequent odour of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by an anionic detergent surfactant, when present. The perfume ingredients and compositions suitable to be used herein are the conventional ones known in the art. Selection of any perfume component, or amount of perfume, is based solely on aesthetic considerations.

Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. In general, the degree of substantivity of a perfume is roughly proportional to the percentages of substantive perfume material used. Relatively substantive perfumes contain at least 1%, preferably at least 10%, substantive perfume materials. Substantive perfume materials are those odorous compounds that deposit on surfaces via the cleaning process and are detectable by people with normal olfactory acuity. Such materials typically have vapour pressures lower than that of the average perfume material. Also, they typically have molecular weights of 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, paracymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

The compositions herein may comprise a perfume ingredient, in amounts up to 5.0%, preferably in amounts of 0.1% to 1.5% by weight of the total composition.

Chelating Agent

Another class of optional compounds for use herein includes chelating agents.

Chelating agents may be incorporated in the compositions herein in amounts ranging up to 10.0%, preferably 0.01%, to 5.0% by weight of the total composition.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, propylene diamine tetracetic acid. (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Bleaches

The liquid compositions herein may also comprise a bleaching component. Any bleach known to those skilled in the art may be suitable to be used herein including any peroxygen bleach as well as any hypohalite bleach.

Suitable peroxygen bleaches for use herein include hydrogen peroxide or sources thereof. As used herein a source of hydrogen peroxide refers to any compound which produces active oxygen when said compound is in contact with water. Suitable water-soluble sources of hydrogen peroxide for use herein include percarbonates, preformed percarboxylic acids, persilicates, persulphates, perborates, organic and inorganic peroxides and/or hydroperoxides.

Suitable hypohalite bleaches for use herein include chlorine releasing components as, e.g., alkali metal hypochlorites. Advantageously, the compositions according to the present invention are stable in presence of this bleaching component. Although alkali metal hypochlorites are preferred, other hypochlorite compounds may also be used herein and, e.g., can be selected from calcium and magnesium hypochlorite. A preferred alkali metal hypochlorite for use herein is sodium hypochlorite.

Bleach Activators

In a preferred embodiment wherein the compositions of the present invention comprise a peroxygen bleach, said compositions may further comprise a bleach activator.

By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides.

Examples of suitable compounds of this type are disclosed in British Patent GB 1 586 769 and GB 2 143 231 and a method for their formation into a prilled form is described in European. Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

Packaging Form of the Compositions

The compositions herein may be packaged in a variety of suitable detergent packaging known to those skilled in the art. The liquid compositions are preferably packaged in conventional detergent plastic bottles.

In one embodiment the compositions herein may be packaged in manually or electrically operated spray dispensing containers, which are usually made of synthetic organic polymeric plastic materials. Accordingly, the present invention also encompasses liquid cleaning compositions of the invention packaged in a spray dispenser, preferably in a trigger spray dispenser or pump spray dispenser.

Indeed, said spray-type dispensers allow to uniformly apply to a relatively large area of a surface to be cleaned the liquid cleaning compositions suitable for use according to the present invention. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g., a grid or a cone or the like, thereby providing shocks to help atomise the liquid composition, i.e., to help the formation of liquid droplets.

EXAMPLES

These compositions were made comprising the listed ingredients in the listed proportions (weight %).

| Ingredients (% by weight) | I | II | III | IV | V | VI | VII | VIII | IX | X | XI |
|---|---|---|---|---|---|---|---|---|---|---|---|
| Dobanol ® 91-8 | 1.3 | | 1.5 | — | 3.5 | — | — | — | 2.5 | — | — |
| Isalchem 123 AS ® | — | 1.5 | — | 3.5 | — | 1.4 | 5.0 | — | — | 3.0 | 3.0 |
| Lutensol ® AO 30 | — | — | — | — | — | 1.5 | — | 2.0 | — | — | — |
| n-BPP | 2.0 | 2.0 | 2.0 | — | 2.0 | 2.0 | 2.0 | — | 3.0 | 5.8 | 2.0 |
| Benzoic acid | 3.5 | — | — | — | — | 1.5 | 5.5 | — | — | — | — |
| Adipic acid | — | 2.0 | 1.0 | — | — | 0.5 | — | 5.0 | — | — | — |
| Succinic acid | — | — | 1.0 | — | 1.5 | — | — | — | 3.5 | 2.5 | — |
| Telluric acid | — | — | — | 1.5 | — | — | — | — | — | — | 4.0 |
| Luviskol K60 ® | 0.1 | — | — | 0.05 | 0.1 | — | 0.1 | — | — | 0.1 | 0.1 |
| Kelzan T ® | 0.3 | 0.6 | — | 0.3 | — | — | — | 0.3 | — | — | 0.3 |
| Waters & Minors | - - - up to 100 - - - | | | | | | | | | | |

The pH of these examples is acidic.

Isalchem 123 AS® is a branched alkyl sulphates commercially available from Enichem.

Kelzan T® is a Xanthan gum supplied by Kelco.

Luviskol K60® is a Polyvinylpyrrolidone supplied by BASF.

n-BPP is butoxy propoxy propanol commercially available from Dow Chemical.

Dobanol® 91-8 is a $C_9$–$C_{11}$ ethoxylated alcohol commercially available from Shell.

Lutensol® AO 30 is a $C_{12-14}$ ethoxylated alcohol commercially available from BASF.

All the above compositions are safe to enamel when used to treat enamel surfaces.

What is claimed is:

1. A process of cleaning an enamel surface with a liquid acidic composition comprising at least one enamel safe acid, the process comprising applying the composition directly to the enamel surface in either dilute or neat form, wherein the at least one enamel safe acid has a $pK_a$ of 3.5 or higher, wherein the composition is free of any acid having a $pK_a$ of less than 3.5 and free of mono-lower alkyl, phenyl or benzyl ethers of diethylene glycol, wherein the lower alkyl comprises 2 to 6 carbon atoms, and wherein the composition is substantially free of any source of enamel-damaging cations.

2. The process according to claim 1 wherein the $pK_a$ of the at least one enamel safe acid is greater than 4.0.

3. A process according to claim 1 wherein said composition comprises from 0.1% to 10% by weight of the total composition of said enamel safe acid.

4. A process according to claim 1 wherein said composition further comprises a surfactant.

5. A process according to claim 4 wherein said composition comprises up to 15% by weight of the total composition of said surfactant.

6. A process according to claim 1 wherein said composition further comprises a solvent.

7. A process according to claim 6 wherein said composition comprises from 0.1% to 8% by weight of the total composition of said solvent.

8. The process according to claim 1 wherein the $pK_a$ of the at least one enamel safe acid is greater than 4.5.

9. The process according to claim 1 wherein the composition has a pH of from 1 to 5.

10. The process according to claim 1 wherein the composition has a pH of from 2 to 4.

* * * * *